United States Patent [19]

McFiggans et al.

[11] 4,253,015

[45] Feb. 24, 1981

[54] ELECTRONIC POSTAGE METER HAVING AN ACCOUNTING SYSTEM INDEPENDENT OF POWER FAILURE

[75] Inventors: Robert B. McFiggans, Stamford; Alton B. Eckert, Jr., Norwalk, both of Conn.

[73] Assignee: Pitney Bowes Inc., Stamford, Conn.

[21] Appl. No.: 24,812

[22] Filed: Mar. 28, 1979

[51] Int. Cl.[3] ..... G06M 3/12

[52] U.S. Cl. ..... 235/92 FP; 235/92 AC

[58] Field of Search ..... 235/101, 92 AC, 92 FP, 235/92 ST, 92 EA

[56] References Cited

U.S. PATENT DOCUMENTS

| | | | |
|---|---|---|---|
| 2,934,009 | 4/1960 | Bach et al. | 101/235 |
| 3,938,095 | 2/1976 | Check et al. | 364/900 |
| 3,978,457 | 8/1976 | Check et al. | 364/900 |
| 4,003,030 | 1/1977 | Takagi et al. | 235/92 FP |

FOREIGN PATENT DOCUMENTS 2750673 7/1978 Fed. Rep. of Germany .

*Primary Examiner*—Joseph M. Thesz

*Attorney, Agent, or Firm*—David E. Pitchenik; William D. Soltow, Jr.; Albert W. Scribner

[57] ABSTRACT

A postage meter has a printing mechanism positioned on a drum, and a driving gear for rotating the drum to imprint postage on a mailpiece. The driving gear is adapted to be externally driven. The meter also has a shutter bar engageable with the driving gear, and an interposer coupled to the shutter bar for inhibiting movement of the shutter bar. An electronic accounting system is also provided within the meter. A latch, which may be the interposer, is operative in response to the operating voltage for inhibiting more than a determined number of printing cycles. A counting device is incorporated to count printing cycles that were not registered, to thereby enable the electronic accounting system to bring the printing data up to date in the event, for example, of restoration of power following a power failure.

16 Claims, 9 Drawing Figures

Fig. 5
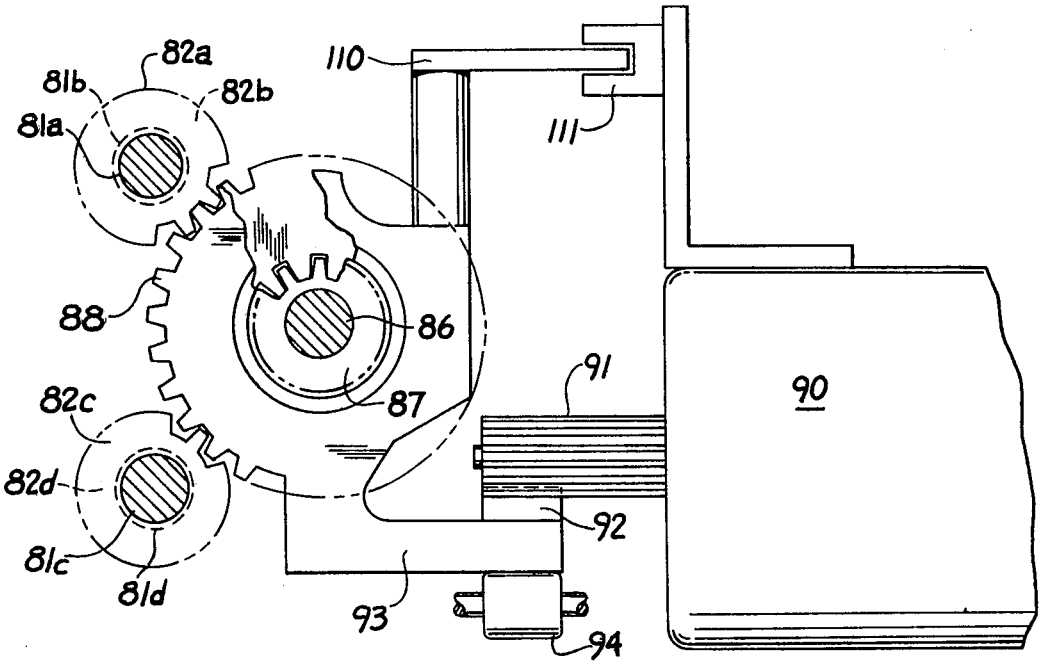
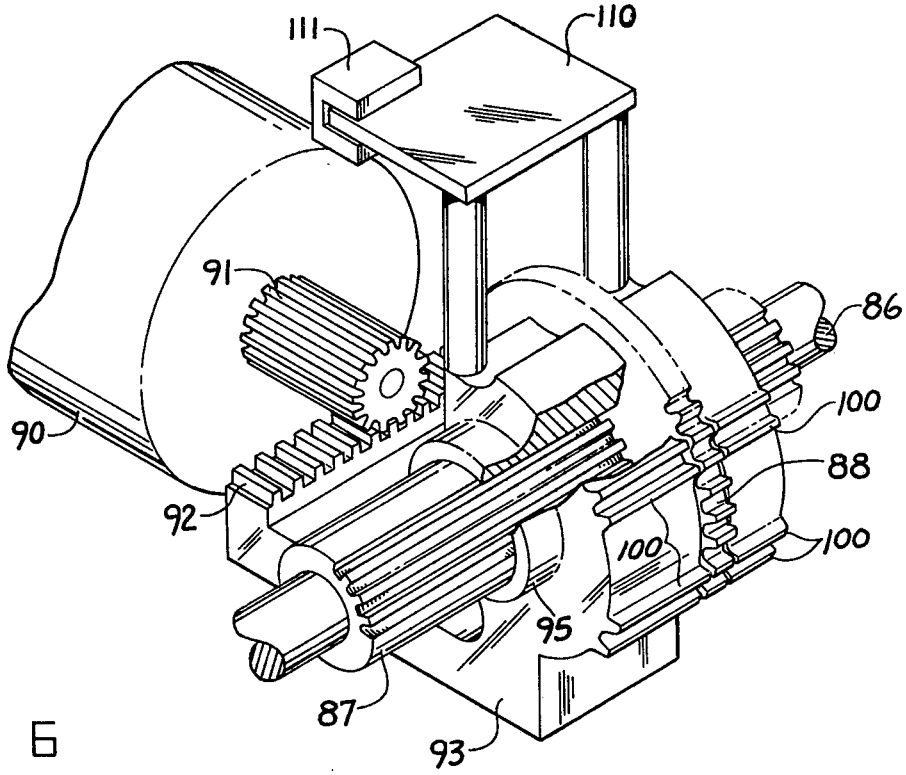
Fig. 6

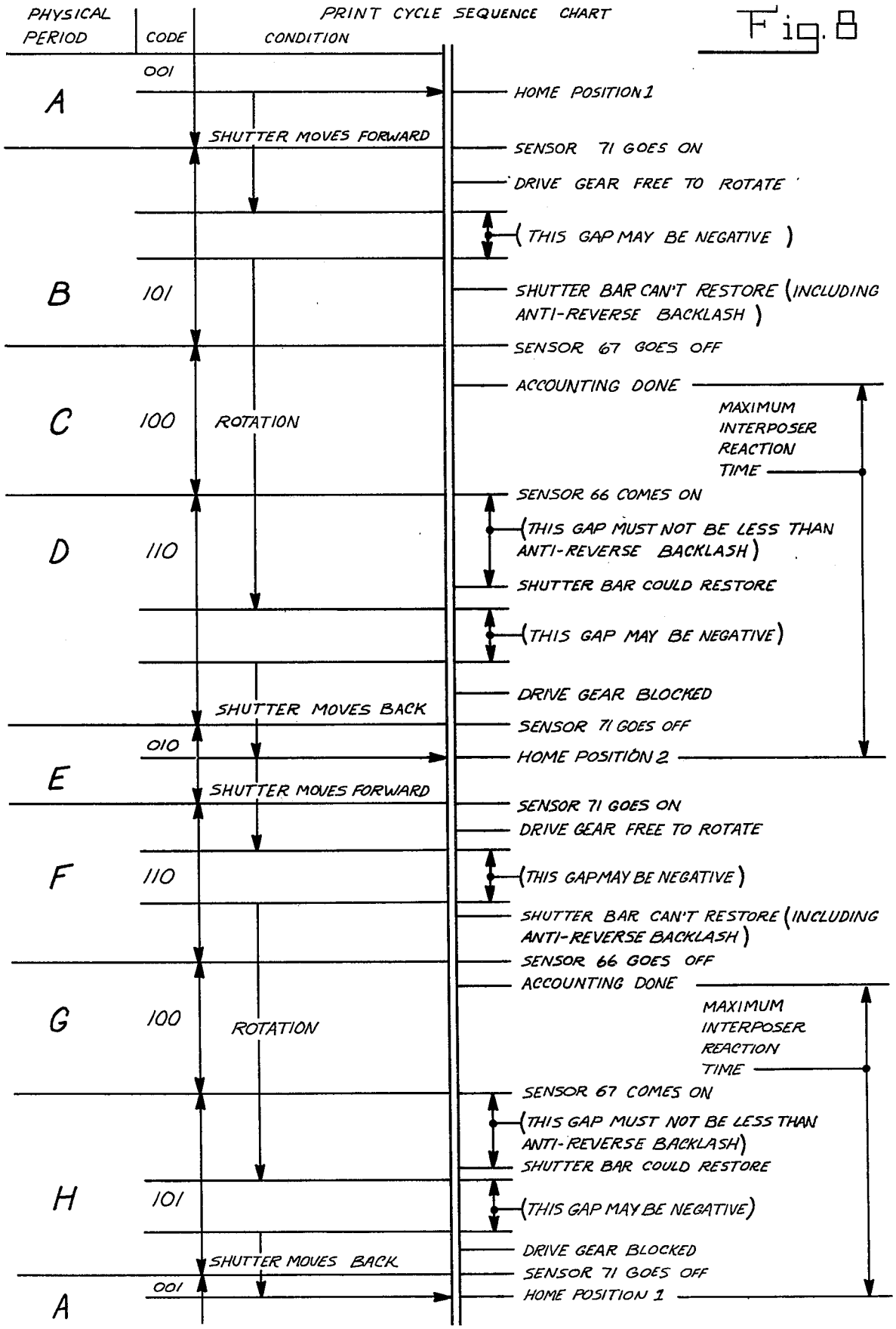
PRINT CYCLE SEQUENCE CHART
Fig. 8
PHYSICAL PERIOD
CODE
CONDITION
A
001
HOME POSITION 1
SHUTTER MOVES FORWARD
SENSOR 71 GOES ON
DRIVE GEAR FREE TO ROTATE
(THIS GAP MAY BE NEGATIVE)
B
101
SHUTTER BAR CAN'T RESTORE (INCLUDING ANTI-REVERSE BACKLASH)
SENSOR 67 GOES OFF
ACCOUNTING DONE
C
100
ROTATION
MAXIMUM INTERPOSER REACTION TIME
SENSOR 66 COMES ON
D
110
(THIS GAP MUST NOT BE LESS THAN ANTI-REVERSE BACKLASH)
SHUTTER BAR COULD RESTORE
(THIS GAP MAY BE NEGATIVE)
DRIVE GEAR BLOCKED
SHUTTER MOVES BACK
SENSOR 71 GOES OFF
010
HOME POSITION 2
E
SHUTTER MOVES FORWARD
SENSOR 71 GOES ON
DRIVE GEAR FREE TO ROTATE
F
110
(THIS GAP MAY BE NEGATIVE)
SHUTTER BAR CAN'T RESTORE (INCLUDING ANTI-REVERSE BACKLASH)
SENSOR 66 GOES OFF
ACCOUNTING DONE
G
100
ROTATION
MAXIMUM INTERPOSER REACTION TIME
SENSOR 67 COMES ON
(THIS GAP MUST NOT BE LESS THAN ANTI-REVERSE BACKLASH)
SHUTTER BAR COULD RESTORE
H
101
(THIS GAP MAY BE NEGATIVE)
DRIVE GEAR BLOCKED
SHUTTER MOVES BACK
SENSOR 71 GOES OFF
001
HOME POSITION 1
A

ELECTRONIC POSTAGE METER HAVING AN ACCOUNTING SYSTEM INDEPENDENT OF POWER FAILURE

BACKGROUND OF THE INVENTION

This invention relates to postage meters, and more in particular to electronic postage meters adapted to be mounted on "drive bases".

In postage meter system of one type, a postage meter is provided that is separable from a "drive base". In this type of system, as exemplified in known equipment by the Model 5300 postage meter manufactured by Pitney Bowes, Inc. of Stamford, Connecticut, and meter base Models 5460 and 5600 also manufactured by Pitney Bowes, Inc. of Stamford, Connecticut, the base incorporates means for initiating print cycles of the postage meter, as well as driving means for driving the mechanical printing mechanism of the postage meter. A base for use in such a system is also disclosed in U.S. Pat. No. 2,934,009, Bach, et al.

In known equipment of the above type operating with primarily mechanical means, the postage meter is provided with a printing drum which may incorporate either fixed or settable postage type. The drum is driven internally of the postage meter by a drive gear, the drive gear being adapted to be coupled to a driving gear in the base when the two units are intercoupled. The postage meter further incorporates a shutter bar adapted to be mechanically intercoupled to a shutter lever on the base when the two units are connected together. The shutter bar, or mechanical means coupled thereto, engage and prevent rotation of the drive gear, so that the printing of postage cannot be effective when the shutter is in its closed position. A shutter lever is provided on the driving base, for engaging the shutter bar or mechanical elements coupled thereto, to effect the movement of the shutter bar to its open position upon the initiation of a print cycle by suitable tripping means in the base. If the shutter bar of the postage meter is free to move, the shutter lever may thereby move the shutter bar out of locking engagement with the drive gear. The drive base further incorporates a clutch operative by the shutter lever so that the driving gear in the base may be driven, to in turn drive the drive gear in the postage meter, only if the shutter bar is capable of being moved to its open position. The postage meter further incorporates various blocking, or interposing means, which prevent the opening of the shutter bar in the event of certain conditions, for example, the absence of adequate postage available as stored in a mechanical register in the postage meter itself, or the mounting of the meter on an improper base.

In systems of this type, the base need not be secure, and may be a device sold as a retail item. The postage meter itself, however, is mechanically secure, i.e., it is enclosed in a secure housing so that the critical accounting and printing equipment cannot be tampered with, without rendering such tampering obvious to postal authorities.

In a primarily mechanical system of the above type, postage accounting registers in the postage meter are generally of a mechanical nature, so that conditions cannot normally occur that which prevent the registration of any printing cycle to effect the strorage of data corresponding to all postage that has been printed.

With the advent of economical electronic control systems, especially microcomputer systems, it is feasible to incorporate electronic accounting devices within the postage meter. Such electronic devices provide certain advantages, such as more rapid accounting of postage, to enable the use of the postage meters in high speed equipment. The electronic devices also may be more economically produced on a mass production basis, and minimize the weight, size and cost of production of the postage meter devices. Further, the provision of electronic accounting means within the postage meter renders the meter capable of additional functions that were not readily achievable in the primarily mechanical devices.

Electronic postage members of the above type are disclosed, for example, in U.S. Pat. Nos. 3,938,095, Check, Jr., et al and 3,978,457, Check, Jr., et al.

Certain difficulties may arise in the use of an electronically accounting postage member in combination with a base of the above described type.

This problem arises from the fact that if a power source to the accounting registers is accidentally or intentionally removed as soon as the printing cycle has been initiated and the shutter bar has moved to release the postage member drive, the printing cycle may be completed, but the postage printed may not be accounted since the electronic registers are unpowered.

SUMMARY OF THE INVENTION

The present invention is therefore directed to an improved postage meter of the type having:

1. An electronic accounting means or, more broadly, an accounting means dependent upon the proper application of an electric operating voltage or current, for its operation;
2. A printing mechanism;
3. An input for receiving driving energy for the printing mechanism, preferably but not limited to mechanical driving energy;
4. A lock-out mechanism such as a shutter bar which can prevent a printing cycle by directly or indirectly inhibiting the input of driving energy, but it cannot prevent the completion of a printing cycle once it has been initiated; and
5. Intercoupling between the accounting means and the printing mechanism or driving energy input system for effecting the registration of postage some time following the initiation of the printing cycle.

Specifically, the invention is directed to a postage meter of the above type wherein means are provided for temporarily registering one or more printing cycles that cannot properly be registered in the accounting means due, for example, to the loss of electric operating voltage or current.

While means may be provided in the above described type of postage meter to ensure that the drive for the printing drum is locked out at any time that the electrical power for the counting system is lost, or is inadequate for effecting registration of printed postage, in order to overcome at least a part of the problem, on some occasions this would not be satisfactory if, under determined circumstances, it is desired to complete any printing cycle that has already been initiated.

In accordance with the invention, the problems involved in the provision of the former solution may be overcome by providing an arrangement wherein a postage cycle, once initiated, will be continued to completion under the driving power of the base, but unaccounted postage printing is stored, for example by mechanical means such as a bistable or multistable mechanical element, so that the occurrence of one or more unaccounted printing cycles may be detected and registered upon the return of the equipment to operative conditions.

BRIEF FIGURE DESCRIPTION

In order that the invention will be more clearly understood, it will now be disclosed in greater detail with reference to the accompanying drawings, wherein:

FIG. 5 is a partially cross sectional side view of a portion of the system of FIG. 4;

FIG. 6 is a simplified diagram of a driving system in accordance with the arrangement of FIG. 5;

FIG. 8 is a timing and flow diagram of a system in accordance with the invention.

DETAILED DESCRIPTION OF THE INVENTION

Figure 1:
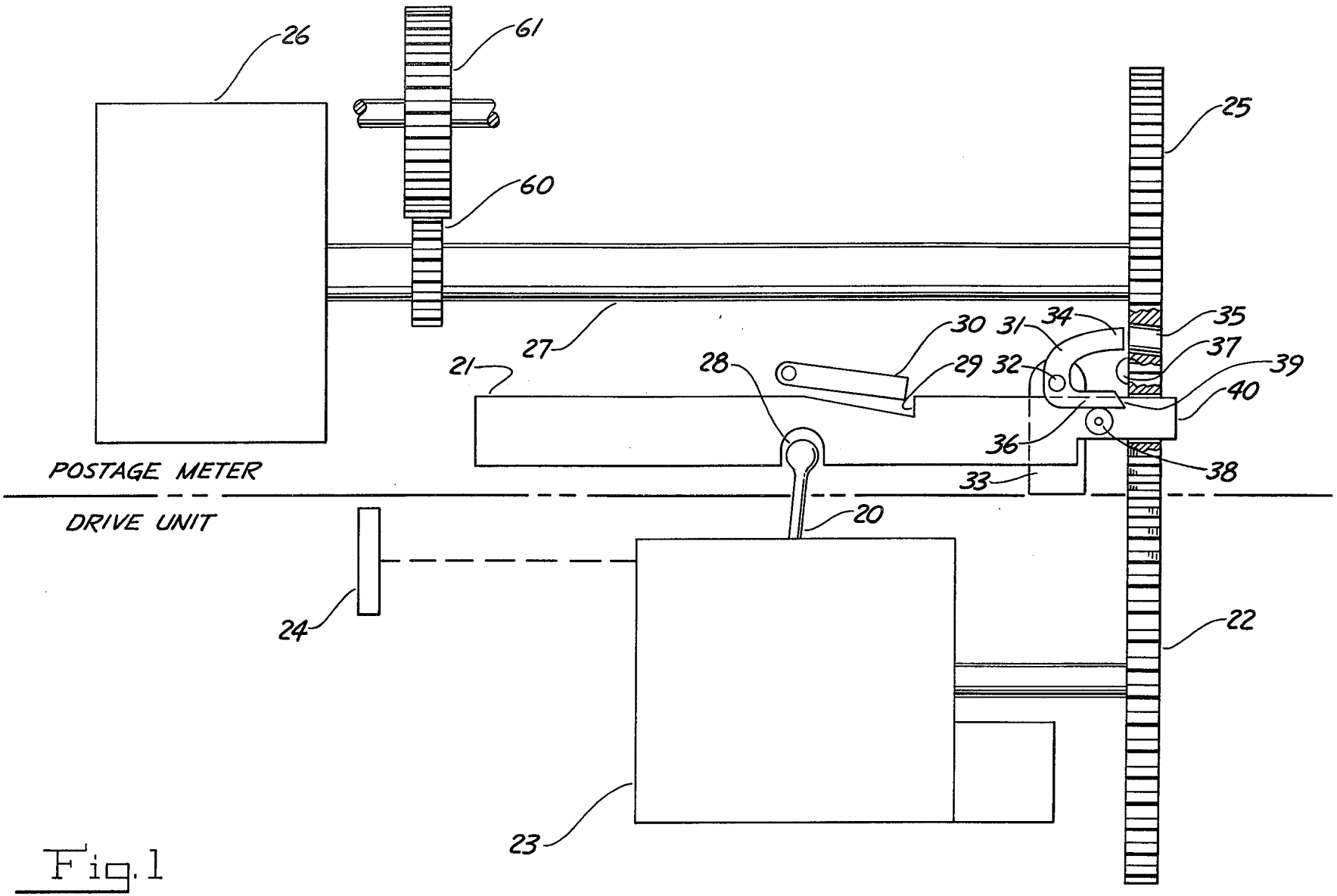
FIG. 1 is a simplified illustration of a postal printing system in accordance with one embodiment of the invention.

A simplified illustration of a mechanism in accordance with the invention is illustrated in FIG. 1, wherein a drive unit, below the dash-dot line, is of the type disclosed in U.S. Pat. No. 2,934,009, Bach, et al. This unit has a shutter lever 20 for operating the shutter bar 21 of the postage meter above the dash-dot line, and a base driving gear 22, controlled by a driving mechanism 23. Initiation of a printing cycle is effected by the tripping of a trip finger 24, mechanically coupled to the drive mechanism, to initially tend to move the shutter lever from its home position as illustrated, to the left of the illustrated position.

While the details of the operation and system of the drive unit are not material to the present invention, it will be noted that if, for any reasons, the shutter bar 21 cannot be operated by the shutter bar drive lever 20, upon the initiation of a driving cycle, then the shutter bar lever drive in the drive unit cannot operate a clutch in the drive unit, and as a result the power input of the drive unit is not applied to the drive input of the postage meter by way of the driving gear 22. This, and the possibility of jamming of the drive unit if the shutter bar cannot move forward, constitute the only control that the postage member has over the operation of the drive unit.

As in a conventional postage meter (e.g. Model 5300 manufactured by Pitney Bowes, Inc. of Stamford Connecticut), the postage meter in accordance with the invention has a driven gear 25 of the same size, and adapted to mesh with the driving gear 22. The driven gear 25 rotates the print drum 26, through a single rotation, to effect the printing of postage. A shaft 27 interconnects the gear 25 and drum 26.

The postage meter further has a shutter bar with a notch 28 or the like for receiving the end of the shutter lever 20. The shutter bar 21 is further provided with a notch 29 for receiving the pawl or bail 30 of the interposer, for inhibiting movement of the shutter bar from its closed position (as shown), while permitting movement of the shutter bar to its closed position. The operation of the interposer will be disclosed in greater detail in the following paragraphs.

In addition, the arrangement of FIG. 1 is provided with a bistable latch in the form of a generally U-shaped lever 31 centrally pivoted at its axis 32 to a suitable frame element 33. The latch lever 31 has one arm 34 positioned to engage a hole 35 in the driven gear 25, and a further arm 36 has a surface 39 positioned to engage a projection or cam 37 extending from the side of the driven gear 25. A further cam surface 38 is provided on the shutter bar, and is also positioned to engage the arm 36 of the latch lever. Suitable detents (not shown) are provided to ensure that the lever is held at either of its positions. The right hand end 40 of the shutter bar 21 engages a hole in the driven gear 25 in the closed position of the shutter bar, to block rotation of this gear. This arrangement is known and used, e.g., in a fully mechanical Model 5300 postage meter.

The system of FIG. 1 as discussed so far operates as follows:

When the drive unit has commenced operation, upon tripping of the trip finger 24, for example, by the passage through the system of an envelope (not shown) or the like, the shutter lever 20 is driven toward the left, to thereby drive the shutter bar 21 from its illustrated closed position leftward to an open position. This driving of the shutter bar can occur if the lock-out bail 30 has been removed from the notch 29, as a result of satisfactory internal states of the components of the postage meter. Upon the driving of the shutter bar to its open position, the base driving gear 22 can commence a single rotation, to thereby drive the driven gear 25 of the postage meter through a single rotation. At this time it will be assumed that the latch 31 is clear of driven gear, as illustrated, so that the single rotation of the gear 25 can be completed. At the end of the single rotation of the gear 25, the cam 37 on this gear engages an inclined surface 39 of the arm 36, thereby rotating the lever 31 about its pivot, and urging the arm 34 thereof into the hole 35 of the gear, the hole 35 being positioned, with respect to the cam 37, to enable such entry of the arm 34 into the hole 35 at the end of the printing cycle, to thereby effect the blocking of further rotation of driven gear 25. In this position, the single rotation of the printing drum will have been finished, and the printing will have been effected. It is further evident that another printing cycle cannot occur in this position of the latch, since the drive gear 25 cannot now be rotated.

Following the completion of the printing of postage, in a correct cycle, the shutter lever 20 will have returned the shutter bar 21 to its closed position. As the shutter bar approaches its closed position, the cam 38 thereon engages the arm 36 of the latch lever 31, so that shortly after the latch has blocked operation of the gear 25, it will have been returned to its unblocking position as illustrated by virtue of the fact that the shutter 21 has been properly closed. Shortly prior to the closing of the shutter bar, however, i.e., while the driven gear is still blocked, the notch 29 will have been positioned to again receive the lock-out bail 30. The lock-out bail 30 is spring operated, so that this bail is effective even though electrical power has been lost. In other words, if electrical power has been lost at some point in the sequence of operations, the next printing cycle cannot be effected.

It is further to be noted that the shutter bar 21 has extension 40 extending through a hole aligned therewith in the driven gear 25, so that there is not possibility that the gear 25 can be driven in the closed position of the shutter bar.

It will be noted that the blocking of the driven gear 25 may be effected either by the latch 31 or the shutter bar 21. This is necessary in order, particularly in high speed operation, to prevent the second rotation of the gear 25 before the shutter bar has had an opportunity to be moved into its closed position. The shutter bar 21 is dimensioned so that the blocking of the driven gear 25 thereby upon movement of the shutter bar to its closed position is effected prior to the release of the driven gear 25 by the latch 31, upon the resetting of the latch by the shutter bar as above indicated.

Figure 2:
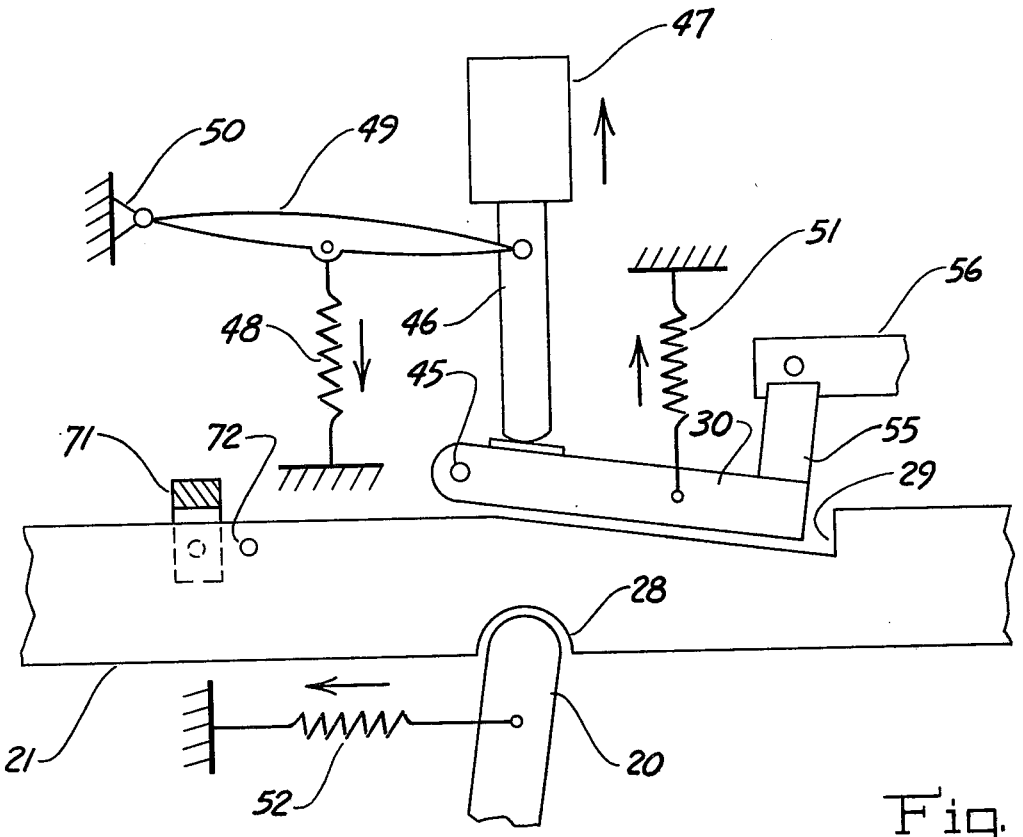
FIG. 2 is a simplified illustration of a system for controlling the interposer of the arrangement of FIG. 1.

The lock-out bail of the system of FIG. 1 may be controlled in the manner illustrated diagrammatically in FIG. 2, wherein the bail 30 is pivoted at one end for rotation about an axis 45 and adapted to engage the notch 29 of the shutter bar 21. The bail is held in the locking position by means of force exerted downwardly on the core 46 of an actuator 47 in its non-energized state, for example, by means of a spring 48 of relatively large force. The spring 48 is centrally disposed on an intermediate lever 49, this lever being pivoted to the core 46 at one end, and fixedly pivoted to a frame element 50 at its other end. The bail 30 is thereby resiliently held in locking engagement with the notch 29 whenever the solenoid 47 is not energized.

Upon energization of the solenoid, the core 46 is moved upwardly against the force of the spring 48, so that a relatively light spring 51 connected to the bail may resiliently urge the bail out of locking engagement with the shutter bar 21. This permits the shutter lever 20 to urge the shutter 21 to the left, as diagrammatically shown in FIG. 2, by the force of a spring 52 in the drive unit.

In the control system for the postage meter, it is desirable to provide an electrical indication of the withdrawal of the bail from the shutter bar. For this purpose, as illustrated in FIG. 2, the bail 30 may have an arm 55 thereon positioned to intercept the light beam of an electro-optic sensor 56 in the unlocked position. This type of mounting for the sensor ensures fail safe operation, as will be discussed in greater detail in the following paragraphs.

In this arrangement, the spring 51 of relatively light force is employed in order to avoid erroneous operation in the event a printing cycle has been triggered prior to the restoration of power. In this instance, there may be forces acting on the shutter, and the light spring 51 does not have sufficient force to unlock the interposer due to the frictional force between the shutter bar and bail. The operator of the mechanism must therefore reset the postage meter, i.e., to cancel out the effect of tripping the meter, in order to return the postage meter to an operative condition. This feature is well-known in mechanical postage meters. The arrangement illustrated in FIG. 2 is thus new to the present invention only in the provision of the sensors, and the operation of the bail by a solenoid.

As illustrated in FIG. 1, a gear 60 may be coupled to the shaft 27, for driving a further gear 61. The ratio of teeth between the gears 60 and 61 is 1:2, so that the gear 61 is driven through only ½ rotation for each printing cycle.

Figure 3:
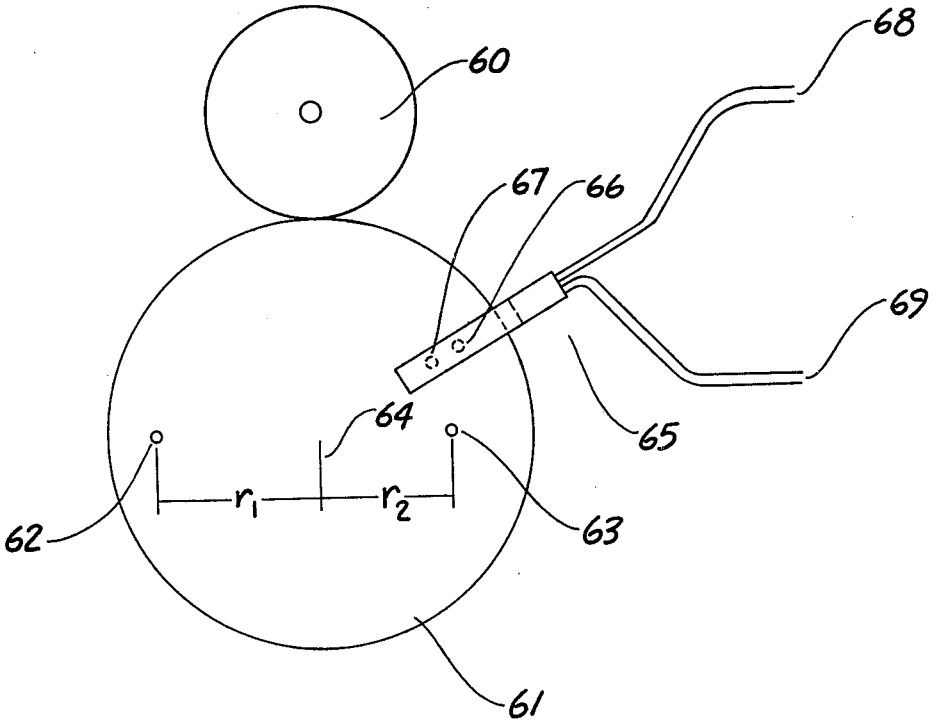
FIG. 3 is a simplified illustration of the indicating disk arrangement of FIG. 1.

As illustrated more clearly in FIG. 3, the gear 61 is provided with two holes 62 and 63 on a common diameter, on opposite sides of the axis 64. The hole 62 is located at a radius $r_1$ from the axis 64 and the hole 63 is positioned at a different radius $r_2$ from the axis 64. An optical sensor 65 is positioned to sense the alignment thereof with the holes 62 and 63, the sensor 65 having one LED-Sensor arrangement 66 in alignment with the radius $r_1$, and the other LED-Sensor 67 arrangement at the radius $r_2$ so that the positioning of the hole 62 along the radius at which the sensor 65 is located results in an output signal from the leads 68, and the positioning of the hole 63 along the radius at which the sensor 65 is located results in an output on the leads 69 of the sensor 65. As a consequence, it is evident that the arrangement of FIGS. 1 and 3 functions as a two step counter, or as a memory, for indicating alternate drum rotation cycles. The leads 68 and 69 may thereby be connected to the register of an accounting system, for determination as to whether or not a given printing cycle has been registered.

Figure 4:
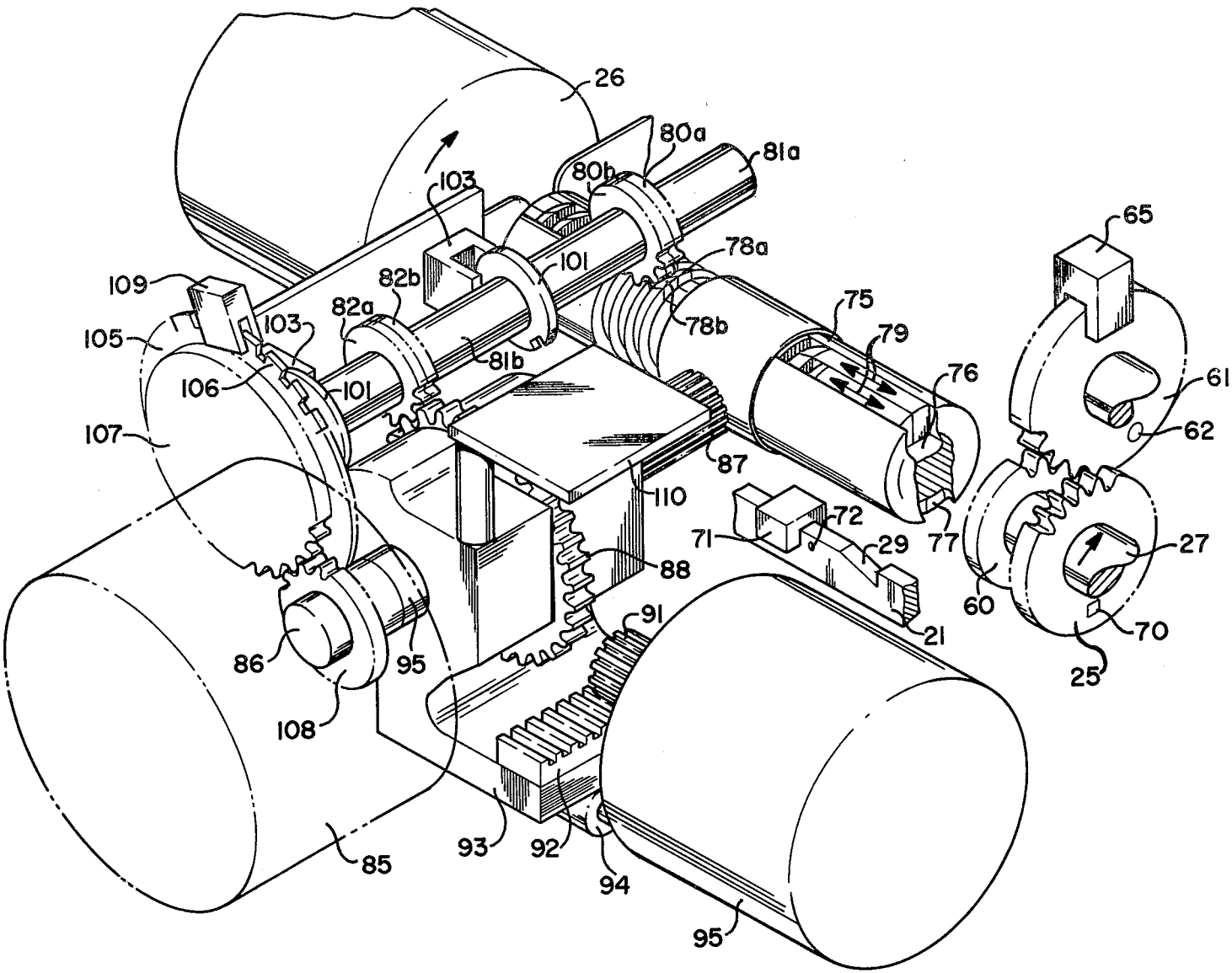
FIG. 4 is a perspective view of a printing mechanism adapted for use in the system of the invention.

The mechanical portion of a system which may be employed, in combination with the improvements of the present invention, is illustrated in FIGS. 4, 5 and 6. This arrangement is essentially a Model 5300 postage meter modified in the general manner disclosed in U.S. Pat. No. 4,050,374, assigned to the assignee of the present application. These figures illustrate modifications of such a system in accordance with the invention.

FIG. 4 generally indicates the print drum 26 rotatable by means of the shaft 27 extending from one end thereof. The drive gear 25, as discussed above, is affixed to the shaft 27. The shutter bar 21 is positioned so that, in this position, one end of the shutter bar 21 can extend into an aperture 70 in the drive gear 25. In addition, the shutter bar 21 is provided with an optical sensor 71 positioned so that it is blocked by the shutter bar 21 (i.e., detects a "dark"), in the home position of the shutter, but is aligned with an aperture 72 when the shutter is fully open.

In the arrangement illustrated in FIG. 4, the drum shaft 27 is enlarged at the end 75 thereof toward the printing drum 26, and this enlarged portion of the shaft 27 carries a pair of opposed longitudinally extending slide channels 76 and 77. A pair of racks **78*a* and 78*b* are provided in the upper channel 76, and a pair of similar racks are provided in the lower channel 77. These four racks have teeth which extend in grooves of the drum shaft, so that they may be engaged by separate pinion gears in the home position of the printing drum. Internally of the printing drum, the racks are connected to separate print wheels (not shown) as in a conventional postage meter Model 5300, so that the longitudinal displacement of the racks, as indicated by the arrows 79**, effects the separate setting of the different print wheels. This feature does not form a part of the present invention, per se.

The remainder of the structure illustrated in FIG. 4–6 is concerned with the axial positioning of the print wheels by way of the above-mentioned racks, by signals derived from an electronic computing circuit, while ensuring accuracy and dependability of the system.

In order to move each rack, a separate pinion is provided, the pinions having longitudinally fixed positions on their respective axes. For example, the rack **78*a* may be driven by a pinion gear 80*a* and the rack 78*b* may be driven by the pinion gear 80***b*. The gear 80*a* is mounted for rotation with a shaft 81*a*, while the gear 80*b* is mounted on a tubing 81*b* rotatably mounted on the shaft 81*a*. As a consequence, the two pinion gears 80*a* and 80*b* may be independently rotated. A driving gear 82*a* is provided on the shaft 81*a*, and a driving gear 82*b* on the tubing 81*b*. The two racks in the lower channel of the drive shaft are driven in the same manner, by pinions on the shaft 81*c* and surrounding tube 81*d* and carrying driving gears 82*c* and 82*d* respectively, as illustrated in FIG. 5.

The driving gears 82*a*-82*b* are sequentially driven by a common stepping motor 85. The shaft 86 of the stepping motor 85 is connected to drive a spline shaft 87, and a main driving gear 88 is slidably mounted on the spline shaft 87. The driving gears 82*a*-82*b* are disposed in spaced apart planes, so that the main driving gear 88 may be moved axially along its spline shaft, to separately rotate the different drive gears 82*a*-82*d*.

For this purpose, a second stepping motor 90 is provided, the stepping motor 90 being provided with a pinion gear 91 for moving a rack 92 in a direction parallel to the axis of shaft 86. The rack 92, is affixed to a yoke assembly 93, which may be supported on rollers 94. The yoke assembly 93 carries a pair of bushings 95 surrounding the spline shaft 87 for enabling smooth movement of the yoke assembly along the spline shaft 87. The main driving gear 88 is disposed in the central slot of the yoke assembly, so that movement of the yoke assembly, under the control of the stepping motor 90, effects the longitudinal movement of the main drive gear 88 along the spline shaft. It is hereby apparent that the stepping motor 90 may be controlled to select which of the print wheels of the printing drum is to be selected at any given instant. It is further to be noted that teeth 100 are provided on the yoke assembly, these teeth being aligned with the teeth of the main driving gear, and engaging the driving gears 82*a*-82*d* which are not, at that instant, in a position to be driven by the main driving gear. This feature enables the locking of the print wheels when they are not being set by the main driving gear.

The system of FIG. 4 may further include additional sensors enabling the electronic control system to receive data corresponding to the setting of the print wheels and the preparedness of the system for printing postage. For example, notched wheels 101 on the tubing 81*b* and shaft 81*a* are positioned to cooperate with optical couplers 103, to indicate that the printing wheels are in "home" positions, i.e., positions at which the print wheels are set to print zero postage. For this purpose, the wheels may have suitable notches or holes positioned to be aligned with respective sensors at the home positions. Similar detecting arrangements may be provided for detecting the home positions of the print wheels controlled by the racks in the lower channel 77. In order to indicate the positioning of the print wheels, during their setting to assigned values, a disk having notches 106 or holes therein, is mounted to rotate with a gear 107, this gear being rotated by a pinion gear 108 on the stepping motor shaft 86. The wheel 105 is positioned to cooperate with an optical sensor 109 of conventional construction. As a consequence, as any given print wheel is being set, pulses are sequentially emitted from the common sensor 109, so that the control arrangement can count such pulses to be able to determine the positioning of the print wheels. In the preferred mode of operation, the optical sensor 109 detects a "dark" in the positions intermediate the postage printing positions of the print wheels. It will be apparent that the detectable markings on the wheel 105 may be arranged in other fashions, so that, for example, two or more similar sensors may be arranged to provide coded data output unique to each setting position.

Similarly, a bracket 110 may be carried by the yoke assembly 93, the bracket 110 having a plate cooperatively positioned with respect to affixedly mounted sensor 111. The bracket 110 may carry holes or slots therein, so that the yoke may be accurately positioned to set the desired print wheel, and to indicate the locking position for all the print wheels. The sensor 111 may be comprised of several optical sensing devices, in order to provide a binary output signal for the control apparatus, if desired. The control of such a system is disclosed, for example, in U.S. Pat. No. 3,978,457, Check, et al.

Figure 7:
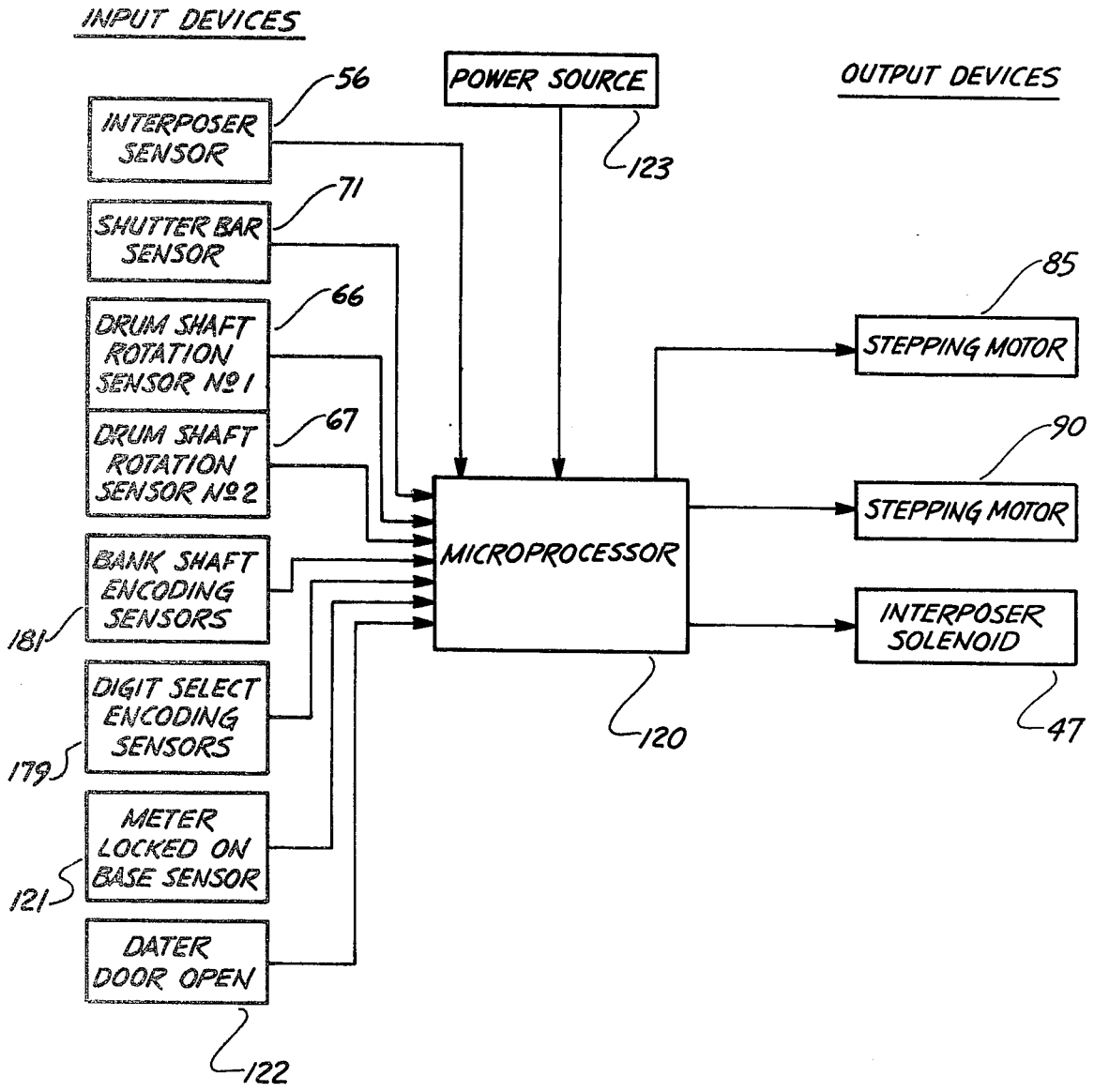
FIG. 7 is a simplified block diagram of one embodiment of an electronic accounting system that may be employed in the invention.

While the electronic circuitry of the postage meter in accordance with the invention may be hard wired, for example, in a manner such as disclosed in U.S. Pat. No. 3,938,095, it is preferred that a software technique be employed. The general system is thereby shown in FIG. 7, and includes a microprocessor 120 of generally conventional construction. The microprocessor is wired to receive input data from the various devices above-discussed, as well as any further data that may be desired in a particular circumstance. For example, a sensor 121 may be provided for determining if the postage meter is locked on its base, and a third sensor 122 may be provided to indicate whether or not the dater door is open. The microprocessor 120 is also able to detect various conditions relating to internal operation, such as insufficient postage and the like, in order to be able to also control output devices on the basis of such functions. The stepping motors 85 and 90, and the interposer solenoid 47, as discussed above, are coupled as output devices to the microprocessor, and a suitable power source 123 is provided for the microprocessor. The present invention is primarily concerned with the shutter sensor 71 and the drum shaft rotation sensors 66 and 67, since these sensors provide critical information relative to events that may have occurred following the initiation of a print cycle, if the power for the microprocessor is lost prior to the completion of the printing cycle. The primary steps that the microprocessor will direct, under such circumstances, are concerned with the necessity for bringing the internal registers of the accounting system up to date, i.e., whether no action is to be taken, whether a further accounting is to be effected, whether an incomplete accounting should be finished, and, in the latter situation, if a further accounting process should be effected.

Before proceeding with the discussion of the routines employed in a system in accordance with the invention, several observations should initially be made. The sensors employed in the postage meter are employed to detect data concerning the security of funds, or to serve functional or informational purposes relating to meter operations. For the first of these, it is preferred that optical sensors be employed, both from the standpoint of reliability and for their ability to be tested for correct operations while being read. The remaining sensors may be of any type available, as long as they are sufficiently reliable. When employing optical sensors, fail safe operation can be generally assured if the "dark" condition represents a state such that, if the element being monitored were not in fact in that condition, the failure would be "safe". Further, in order to ensure reliability, each testing sequence should commence with all of the light emitting devices being in a dark state, following which the sensors are initially read. If a "one" is detected at this time, an error is evident. The light emitting devices are then turned on, and following a suitable waiting period the sensors are again read and the data therefrom recorded. In order to further test the devices, the light emitting devices are then turned off, and, following a further waiting period, the sensors are again read. If, at this time, a non-zero is indicated, then there may have been an error in the recorded reading. It goes without saying, of course, that adequate security measures as previously disclosed must be still taken to ensure the mechanical and electronic integrity of the system. The previously disclosed arrangements for this purpose may consequently be employed in combination with the system in accordance with the invention.

FIG. 8 of the drawings is a chart illustrating two print cycles of a postage meter in accordance with the invention, in order to more clearly demonstrate the interaction of the various elements. In this illustration, a binary code is given for each of the positions, in which the most significant digit corresponds to the position of the shutter, "0" indicating the home position. The two least significant digits correspond to the detector sense of the drum shaft rotation sensors 66 and 67 respectively. The print cycle corresponds to two complete rotations of the drum shaft, since the sequence is repeated only after the second complete rotation due to the use of the 2:1 ratio of the teeth of the gears 61 and 60. The periods A and E correspond to the home positions, i.e., positions at rest, with the shutter closed, following a printing cycle and before the initiation of the next printing cycle, for example, by the tripping of the envelope sensing lever. Periods B and F follow the initiation of the printing cycles, and are indicated as occurring from the time the sensor 71 goes on, as a result of movement of the shutter, until the time that either the sensor 66 or the sensor 67 goes off, resulting from the rotation of the drum shaft. The periods C and G are periods of rotation, during which only the shutter sensor 71 provides an output. Finally, the periods D and H define the conditions at which the termination of the printing cycle is close at hand, such that one of the drum shaft rotation sensors comes on. FIG. 8 shows that there may be some overlap in the times of movement of the shutter and the times of rotation of the drum shaft, and indicates generally the tolerances that are permitted in the sequence of the various events. Thus, the accounting in the microprocessor is effected in the periods of rotation C and G, with the maximum interposer reaction time necessarily being taken into consideration.

It must be noted, of course, that the events shown in the sequence chart of FIG. 8 are not based upon the time scale, this chart showing only the relative positions of the various periods and sequences of operation.

Table I is a Table of the sequences of operation, with respect to the sensor readings of the sensors 71, 66 and 67, under normal operating conditions. The error code "ERR" indicates that the sensor reading is prohibited at that time in the sequence, and that steps must be taken to ensure that the process does not continue until the error has been taken care of. The program of the system is therefore set up, in accordance with the routine of Table I. It is noted that, when a previous physical period of B is followed by a sensor reading of 001, indicating physical period A an error signal is not given. This sequence may occur, for example, as a result of backlash, and does not by itself indicate an error has occurred. A similar situation occurs when the previous physical period of F has occurred, and if the new sensor reading is 010.

A different program occurs, however, when a power failure has been detected. The detection of loss of power may occur, for example in the microprocessor itself, or external circuits may be provided for this purpose if desired. This sequence of operation is shown in Table II.

Figure 9:
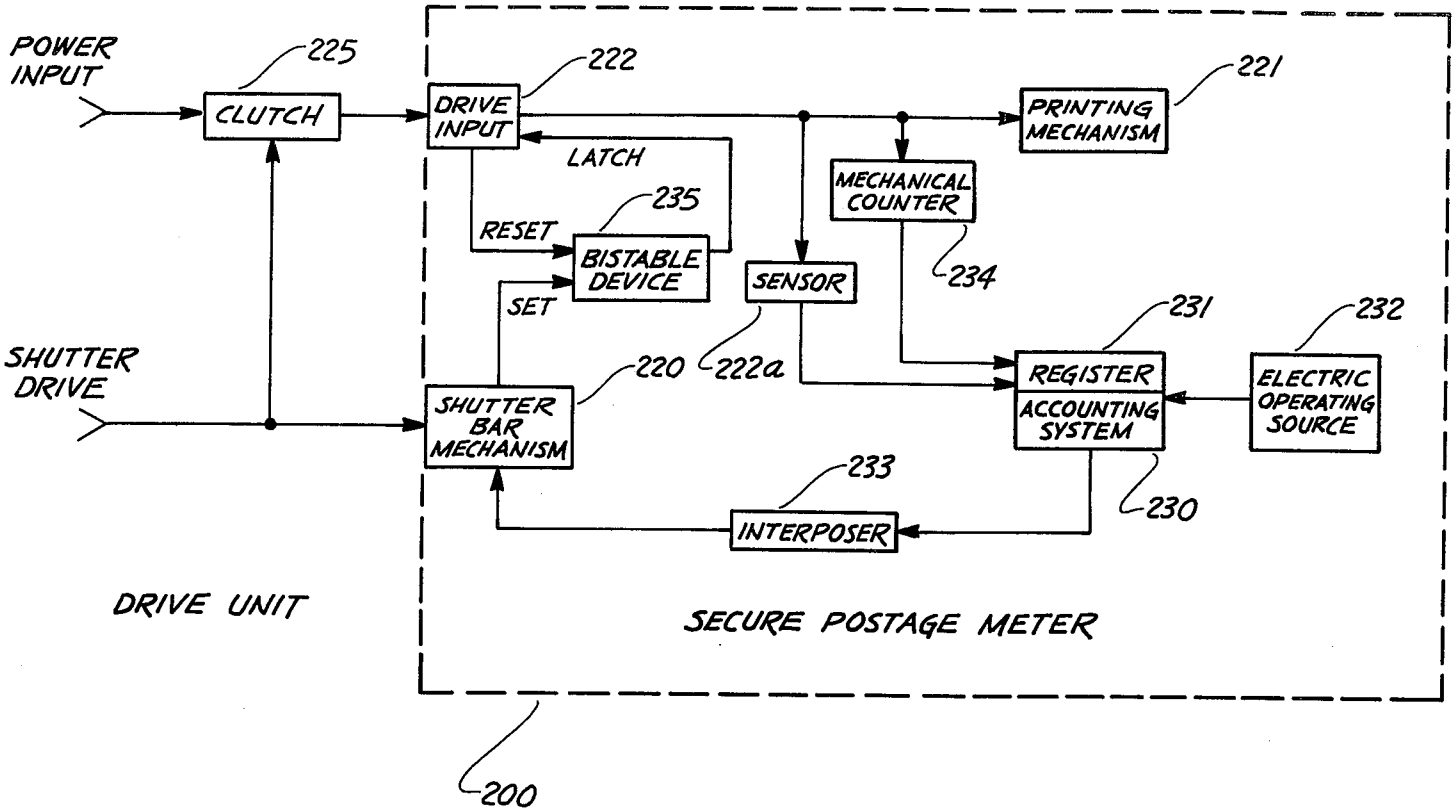
FIG. 9 is a block diagram of a system in accordance with FIG. 1, showing the broader aspects of the invention.

Referring now to the drawings, FIG. 9 illustrates, in a more generalized form, a block diagram of a system in accordance with the aspect of the invention of FIG. 1. In this figure the elements of the drive unit are illustrated to the left of the dashed line box 200, which represents a secure housing, and the elements within the postage meter are illustrated within the dashed line box. The postage meter itself includes a mechanical shutter bar mechanism 220, a mechanical printing mechanism 221, and a drive input 222 for mechanically driving the printing mechanism. For example, the drive input 222 may constitute a gear 25 of FIG. 1 and the shutter bar mechanism 220 constitutes a lever driven shutter bar 21, these elements and the printing mechanism 221 being of the general form employed in the above discussed Model 5300 postage meter and the modification thereof such as disclosed above, for example, as well as in U.S. Pat. Nos. 3,938,095, Check, Jr., et al, 3,978,457, Check, Jr., et al and 4,050,374, Check, Jr., et al.

TABLE I

| Old Logical Status | New Sensor Readings (Sensors 71, 66 and 67) | | | | | | | |
|---|---|---|---|---|---|---|---|---|
| | 000 | 001 | 010 | 011 | 100 | 101 | 110 | 111 |
| A | ERR (TRAP) | A | ERR (TRAP) | ERR (TRAP) | ERR (TRAP) | B | ERR (TRAP) | ERR (TRAP) |
| B | ERR (TRAP) | A | ERR (TRAP) | ERR (TRAP) | C (ACCOUNT) | B | ERR (TRAP) | ERR (TRAP) |
| C | ERR (TRAP) | ERR (TRAP) | ERR (TRAP) | ERR (TRAP) | C | C | D | ERR (TRAP) |
| D | ERR (TRAP) | ERR (TRAP) | E | ERR (TRAP) | C | ERR (TRAP) | D | ERR (TRAP) |
| E | ERR (TRAP) | ERR (TRAP) | E | ERR (TRAP) | ERR (TRAP) | ERR (TRAP) | F | ERR (TRAP) |
| F | ERR (TRAP) | ERR (TRAP) | E | ERR (TRAP) | G (ACCOUNT) | ERR (TRAP) | F | ERR (TRAP) |
| G | ERR (TRAP) | ERR (TRAP) | ERR (TRAP) | ERR (TRAP) | G | H | G | ERR (TRAP) |
| H | ERR (TRAP) | A | ERR (TRAP) | ERR (TRAP) | G | H | ERR (TRAP) | ERR (TRAP) |
| A | ERR | A | ERR | ERR | ERR | B | ERR | ERR |

TABLE I-continued

| Old Logical Status | New Sensor Readings (Sensors 71, 66 and 67) 000 | 001 | 010 | 011 | 100 | 101 | 110 | 111 |
|---|---|---|---|---|---|---|---|---|
| ERR | (TRAP) ERR (TRAP) | ERR (TRAP) | (TRAP) ERR (TRAP) | (TRAP) ERR (TRAP) | (TRAP) ERR (TRAP) | ERR (TRAP) | (TRAP) ERR (TRAP) | (TRAP) ERR (TRAP) |

TABLE II

POWER RECOVERY

| Logical Status at Power Failure | | Status When Returned To Home After Power Recovery | |
|---|---|---|---|
| Logical Period | Condition | Home Position 1 A (1) 001 | Home Position 2 E (2) 010 |
| A | Home Position 1 | No Action | Account |
| B | Tripped at 1 | No Action Finish | Account Finish |
| C | Rotating 1-2 | Accounting, Account Again | Accounting |
| D | Rotation Complete @2 | Account Again | No Action |
| E | Home Position 2 | Account | No Action |
| F | Tripped at 2 | Account Finish | No Action Finish |
| G | Rotating 2-1 | Accounting | Accounting, Account Again |
| H | Rotation Complete @1 | No Action | Account Again |

The drive unit includes a source of a mechanical shutter bar driving force for driving the shutter bar mechanism 220, and a power source for driving the drive input 222. The power input in the drive unit is applied to the postage meter by way of a clutch 225 controlled by the shutter drive. The elements of the drive unit may thereby be of the type disclosed in U.S. Pat. No. 2,934,009, Bach, et al. In this embodiment, the shutter bar drive constitutes a shutter bar lever adapted to engage the shutter bar mechanism 220 of the postage meter, and power input system includes a gear for engaging the gear of the drive input 222 of the postage meter.

The postage meter also includes an electrically operative register 231, the accounting system 230 deriving operating power from the source 232, which may be either within or outside of the secure housing. In one type of known accounting system of this type, the register 231 is coupled to sensors **222*a* associated with the drum shaft for enabling the registration of a determined amount in response to the occurrence of the printing cycle, i.e., during the rotation of a drum shaft. Systems of this type are disclosed, for example in U.S. Pat. No. 3,938,095, Check Jr., et al and U.S. Pat. No. 3,978,457, Check Jr. In these systems, the registration is dependent upon the drum shaft having left its home position, the actual amount registered being dependent upon the earlier setting of the printing mechanism. The arrangement of FIG. 1** is also applicable to systems of the type wherein sensors are provided for receiving data concerning the amount to be printed during the actual rotation of the drum shaft. While the invention is particularly concerned with electronic accounting systems employing electronically operative registers, it will be apparent that the problems solved by the invention are equally applicable to any form of accounting system that depends upon an electrical source for its operation.

As is further conventional in postage meters, the shutter bar mechanism 220 may be controlled by the accounting system, so that, for example, the shutter bar mechanism cannot be operated if the accounting system indicates insufficient sums have been paid for to permit the printing of the postage. For this purpose, a mechanical interposer 233 e.g., the bail 30 of FIG. 1, is provided to block the operation of the shutter mechanism. Interposers of this type have been disclosed in greater detail above.

While the above system as discussed so far is satisfactory under most circumstances, it is apparent that a problem occurs in the event that, either accidentally or intentionally, power from the electric operating source 232 is lost some time in the period following the initial movement of the shutter bar mechanism. Such a loss of operating power may result in a failure of the accounting system to register the printed postage. In view of the requirement that all printed postage must be accounted, it is apparent that means must be provided for solving this problem.

In the arrangement in accordance with the invention depicted in FIG. 9, this problem is solved by the provision of the mechanical counter 234 coupling the output of the drive input 222 to the accounting system 230. The mechanical counter 234 is generally in the form of a mechanical device that has a position responsive to the rotation or the like of the drive input, so that at least adjacent printing cycles may be distinguished one from the other. This of course corresponds, in one embodiment, to the gears 60 and 61 of FIG. 1, whereby the sensing devices of FIG. 1 enable the determination of whether or not the electrically driven counters of the accounting system are in the same sequence as the mechanical driven counter on the drum shaft. Since the mechanical counter 234 does not depend for its operation upon electrical power, a record of completed printing cycles in the absence of electrical power can be maintained, to enable later updating of the electronic accounting system, if such be ever necessary. The usefulness of a mechanical counter of the type above disclosed is of course dependent upon the provision of a printing system wherein resetting of the print cannot be effected between the time a setting amount has been recorded in the register and the time the postage is printed, in order that the accounting system may be certain of the amount of printed postage that must be updated. This requirement is met, for example, in the system shown in FIGS. 4–6, as well as in U.S. Pat. No. 4,050,374 by locking of the print wheels from rotation at any time the printing drum can be rotated.

In the system of the invention generally illustrated in FIG. 9, is a bistable device 235 may be provided for latching the drive input 222 in its reset position. In this case, the bistable device is set to one position by the drive input, at the end of a printing cycle, i.e., the end of a rotation of the printing drum. The bistable device 235 is reset only by the shutter bar mechanism 220, to thereby enable the drive input to commence another printing cycle, if the required conditions for operation of the interposer 233 are met in the initiation of a new printing cycle. The bistable device 235 is therefore provided primarily to ensure that a second printing cycle cannot occur until the complete closure of the shutter bar mechanism, in order to permit the interposer to take effect.

The block diagram of FIG. 9 is intended to be functional only, and not represent any particular form of intercoupling between the elements. Thus, such intercouplings may be electrical, mechanical, or even optical. In the preferred embodiments of the invention, however, the interposer 233 mechanically blocks the shutter bar mechanism 220. The sensor 22*a*, if it is provided, preferably is an optical sensor. Other sensors may also be provided, in order to improve the operation of the system. Thus, sensor 66 and 67 may sense the home position of the drum shaft, represented by the connection between the drive input and the printing mechanism 221, in order to provide an indication if the drum shaft was not in home position at any time power is returned to the postage meter.

While the invention is disclosed and described with reference to a limited number of embodiments, it will be apparent that variations and modifications may be made therein, and it is therefore intended in the following claims to cover each such variation and modification as follows within the true spirit and scope of the invention.

What is claimed is:

1. In a postage meter having a secure housing enclosing a settable printing mechanism, a drive input mounted to receive externally originating mechanical drive energy for driving said printing mechanism through printing cycles, an electronic accounting system including a register, sensing means connected to sense printing cycles for updating said register, and setting means for setting the amount to be printed by said printing means whereby said setting means is inoperative if said register is incapable of registering data received by said sensing means;

the improvement comprising counting means having different positions corresponding to the completion of a plurality of sequential printing cycles, sensing means coupled to said accounting means and connected to sense the position of said counting means, said accounting means comprising electronic means for storing data corresponding to the sensed positions of said counting means, and means responsive to differences between said stored data and the sensed position of said counting means for updating said register.

2. The postage meter of claim 1 wherein said counting means is a mechanical element having two different home positions corresponding to sequential printing cycles.

3. The postage meter of claim 2 wherein said drive input comprises a gear, said counting means comprising a disk coupled to rotate with said gear with a 2:1 ratio, said disk having indicia on opposite sides of its axis cooperating with said sensing means at a fixed position for providing signals responsive to the position of said disk.

4. The postage meter of claim 1 further comprising microprocessor means within said secure housing, said data microprocessor having a routine for controlling operation of said postage meter.

5. In a postage meter having a printing mechanism, a register for storing data corresponding to an accumulated value of postage printed by said mechanism, said printing mechanism being operable in discrete multistep printing cycles for printing postage and including means directing data corresponding to postage to be printed in a given cycle to said register; the improvement wherein said register is electrically operative, and further comprising mechanically operative counting means coupled to said printing mechanism, and a means responsive to said mechanically operative counting means for applying data to said register corresponding to the next preceeding data applied thereto when electric operating power for said register has been lost during a printing cycle.

6. The postage meter of claim 5 wherein said printing mechanism comprises a printing drum having settable print wheels therein, and rotatable drive means mounted to receive external originating mechanical drive energy for rotating said drum, mechanically operative counting means comprising disk means coupled to rotate with said printing drum at a lesser angular displacement, and sensing means mounted to sense the angular displacement of said disk means.

7. The postage meter of claim 6 wherein said disk means is coupled to rotate with angular displacements half those of said printing drum, said disk means having detectable means along a common diameter to enable distinction between adjacent half turn displacements from a common fixed sensing position.

8. The postage meter of claim 5 further including lock-out means responsive to the absence of electrical operating energy for said register for inhibiting initiation of printing cycles of said printing mechanism while being incapable of blocking cycles that have already commenced.

9. The postage meter of claim 8 wherein said printing mechanism comprises a rotatable drive means coupled to receive external driving energy for said printing mechanism, and said lock-out mechanism comprises means for blocking rotation of said drive means.

10. In a postage meter having a mechanically operable printing means settable to enable the printing of a determinable postage value and an electronic accounting means, wherein the electronic accounting means includes an electronic register connected to store data corresponding to the sum of postage values printed by said printing means, said postage value being not subject to change during a given printing cycle; the improvement comprising mechanical counting means coupled to provide outputs that are different in dependence on a determined number of sequential printing cycles of said postage meter, said accounting means being connected to maintain a record of said outputs for printing cycles during which said accounting means was energized to receive accounting data, and having a routine for updating data stored in said register when said record stored in said accounting means does not correspond to the current output of said mechanical counting means.

11. The postage meter of claim 10 wherein said printing means comprises a rotatable drum having settable printing wheels therein, and drive means coupled to receive external mechanical drive energy for rotating said drum.

12. The postage meter of claim 11 wherein said drive means comprises rotatable means, and further comprising means for setting said printing wheels, and means inhibiting the setting of said printing wheels during at least a portion of the rotation periods of said drum during a printing cycle.

13. The postage meter of claim 12 further comprising a lock-out mechanism coupled to inhibit initiation of rotation of said drum during a printing cycle but incapable of blocking rotation thereof once a rotation has commenced.

14. The postage meter of claim 13 wherein said mechanical counting means comprises two position counting means responsive to rotation of said drum.

15. The postage meter of claim 14 wherein said two position counting means comprises a rotatable disk coupled to rotate with a 1:2 ratio with said drum and having sensing means on a common diameter for determining alternate half cycles rotational thereof.

16. The postage meter of claim 15 further comprising sensing means at a fixed position for sensing the angular displacement of said disk means.

* * * * *

UNITED STATES PATENT AND TRADEMARK OFFICE

CERTIFICATE OF CORRECTION

PATENT NO. : 4,253,015

DATED : March 28, 1979

INVENTOR(S) : Robert B. McFiggans and Alton B. Eckert

It is certified that error appears in the above-identified patent and that said Letters Patent are hereby corrected as shown below:

Column 3, line 59, please delete "member" and insert --meter--

Column 7, line 6, please insert after 82b --is provided--

Column 7, line 16, "82b" should be --82d--

Column 12, line 32, replace "must" with --must--

Signed and Sealed this

*Twenty-sixth* Day of *October 1982*

[SEAL]

*Attest:*

GERALD J. MOSSINGHOFF

*Attesting Officer*

*Commissioner of Patents and Trademarks*